US005358750A

United States Patent [19]

Brookfield

[11] Patent Number: 5,358,750

[45] Date of Patent: Oct. 25, 1994

[54] INDUSTRIAL FABRICS

[75] Inventor: Frank Brookfield, Rochdale, England

[73] Assignee: Scapa Group PLC, Lancashire, England

[21] Appl. No.: 105,996

[22] Filed: Aug. 13, 1993

Related U.S. Application Data

[63] Continuation-in-part of Ser. No. 804,679, Dec. 11, 1991, abandoned.

[30] Foreign Application Priority Data

Dec. 14, 1990 [GB] United Kingdom ..... 9027143.8

[51] Int. Cl.[5] ..... B32B 27/20; B05D 3/02

[52] U.S. Cl. ..... 427/412; 427/209; 427/381; 427/434.3

[58] Field of Search ..... 427/381, 397.8, 389.9, 427/434.3, 412, 163, 439, 379, 209

[56] References Cited

U.S. PATENT DOCUMENTS

| | | | |
|---|---|---|---|
| 1,931,667 | 10/1933 | Luetscher | 427/439 |
| 2,147,293 | 2/1939 | Hansen | 427/434.3 |
| 3,181,967 | 5/1965 | Amos et al. | 427/209 |
| 3,404,025 | 10/1968 | Wootten | 427/209 |
| 3,928,703 | 12/1975 | Cook | 428/255 |
| 4,501,791 | 2/1985 | Davis | 427/381 |
| 4,588,615 | 5/1986 | Otty | 427/434.3 |
| 4,654,235 | 3/1987 | Effenberger et al. | 427/412 |
| 4,762,736 | 8/1988 | Garvey et al. | 427/434.3 |
| 4,803,101 | 2/1989 | Roberts et al. | 427/381 |
| 5,270,079 | 12/1993 | Bok | 427/434.3 |

FOREIGN PATENT DOCUMENTS

| | | |
|---|---|---|
| 0396765 | 11/1990 | European Pat. Off. . |
| 2601569 | 6/1977 | Fed. Rep. of Germany . |
| 2178005 | 11/1973 | France . |
| 2400658 | 3/1979 | France . |
| WO85/04199 | 9/1985 | PCT Int'l Appl. . |
| 1184467 | 5/1967 | United Kingdom . |
| 2005375A | 8/1978 | United Kingdom . |
| 2122110A | 6/1983 | United Kingdom . |

OTHER PUBLICATIONS

Derwent Abstract of JP 63222852, Mar. 12, 1987.

*Primary Examiner*—Shrive Beck
*Assistant Examiner*—Diana L. Dudash
*Attorney, Agent, or Firm*—Keck, Mahin & Cate

[57] ABSTRACT

An industrial fabric such as a fusing or laminating belt and a method for the production thereof wherein an endless base fabric (21) is coated with successive layers (24, 25,26) of a synthetic plastics coating material, some at least of the layers including silicate bodies therein. The total coating includes at least one layer (25a) applied by lick coating and at least one layer (25, 26) applied by dip coating.

8 Claims, 2 Drawing Sheets

INDUSTRIAL FABRICS

This is a continuation-in-part of application Ser. No. 07/804,679 filed on Dec. 11, 1991, now abandoned.

FIELD OF THE INVENTION

The invention concerns industrial fabrics and has more particular reference to such industrial fabrics as coated fusing and laminating belts and to a method for the manufacture thereof.

BACKGROUND OF THE INVENTION

Endless belts for use in fusing and laminating are known which comprise a base fabric having a coating of polytetra fluoroethylene (P.T.F.E.) applied thereto. Whilst the base fabric is normally of woven open-ended form, the ends being subsequently joined, it is preferred that such fabrics are woven endless thus avoiding seam mark-off.

Smoothness of surface is an important consideration in fusing and laminating belts, particularly in the case of belts for use in the context of high quality fine fabric laminations, and undue prominence at the belt surface of the underlying weave pattern can give rise to unacceptable marking in the fabric lamination.

SUMMARY OF THE INVENTION

The primary object of the present invention is to provide a fusing or laminating belt which offers improved performance as regards marking of the end product.

According to the present invention there is proposed an industrial fabric, and particularly a fusing or laminating belt, comprising an endless woven base fabric and multiple thin layers of a synthetic plastics coating material applied thereto, at least some of the said coating layers including silicate bodies therein thereby to mask the fabric interstices and substantially avoid manifestation of the surface profile of the base fabric at the belt surface.

Preferably the silicate bodies comprise glass beads having a diameter of between 20 and 250 microns.

The invention also includes the method of producing an industrial fabric, particularly a fusing or laminating belt, which includes the steps of providing a woven base fabric, and applying multiple thin coating layers of a synthetic plastics coating material to the said base fabric, at least one of the coating layers containing silicate bodies and the or at least one of the coating layers containing silicate bodies being applied by a lick coating technique.

The lick coating step yields a thin coating which fills the inherent channels in the fabric. The lick coating step also causes air to be expelled through the opposite side of the fabric to the side which is lick coated. After lick coating to fill the recesses on one side of the belt, the belt is then dip coated, as illustrated in FIGS. 1 and 2.

A preferred coating material is PTFE, as described above. PTFE has a high shrinkage on drying. The addition of a large amount of PTFE on one side of the fabric can result in curling of the fabric. Thus a thin layer of PTFE is required. The filling of the channels while maintaining a low curl effect can be achieved by providing a thin layer using a lick coating process.

The subsequent dip coating steps apply much thicker layers of PTFE to both sides of the fabric. PTFE pick up on the non-lick coated side of the fabric is higher than on the lick coated side.

According to a preferred feature, a bonding coat is applied to the base fabric prior to application of the coating layers containing silicate bodies.

BRIEF DESCRIPTION OF THE DRAWING

The invention will now be described further, by way of example only, with reference to the accompanying diagrammatic drawings wherein.

DETAILED DESCRIPTION OF THE PREFERRED EMBODIMENTS

Figure 1:
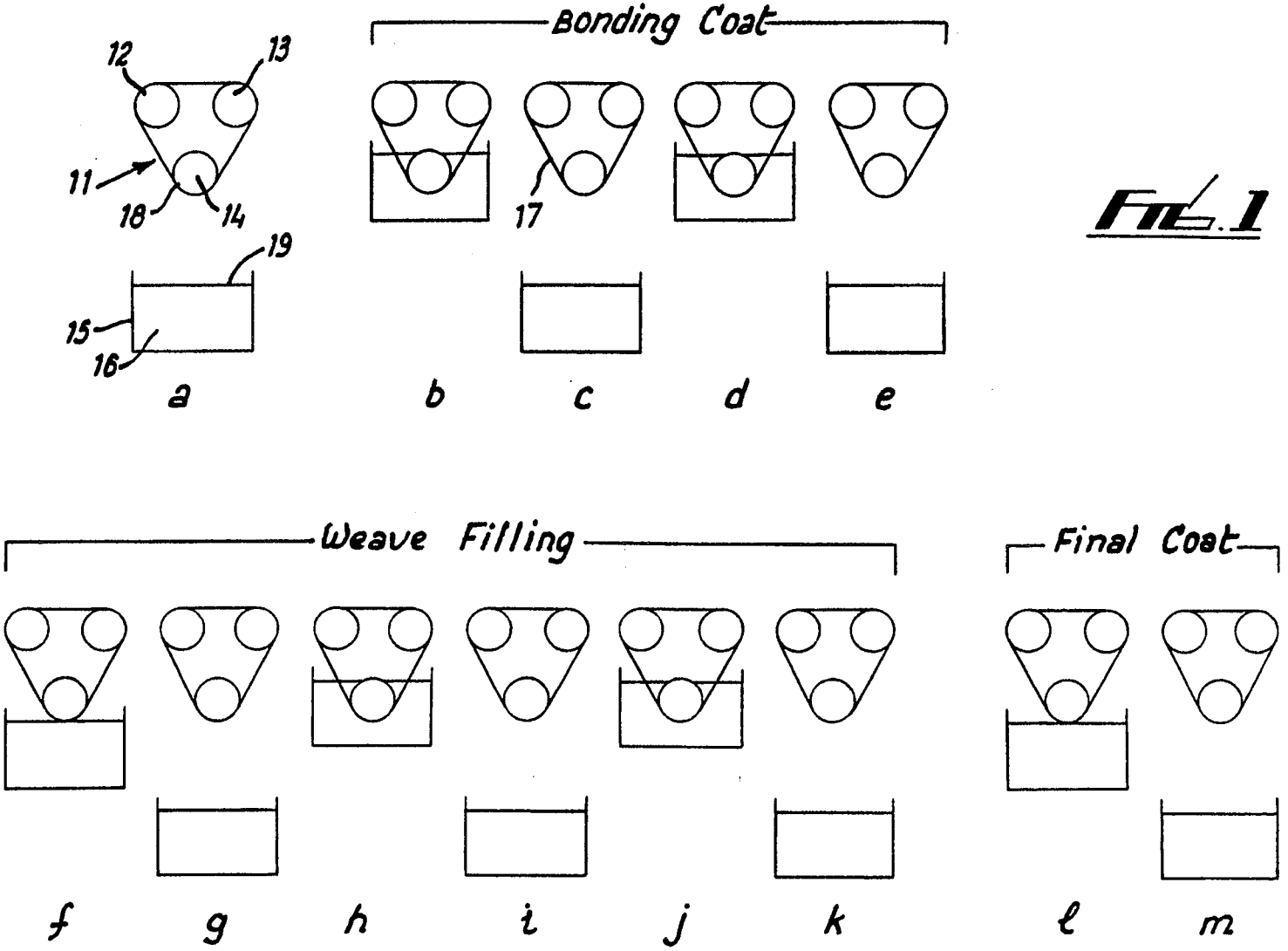
FIG. 1 illustrates the method steps of the invention as exemplified by one embodiment thereof.

Referring now to the drawings, and in particular to FIG. 1 thereof, in coating a woven base fabric to provide a laminating belt an endless woven fabric 11 is supported, under tension, on a plurality of horizontal rollers 12, 13, 14 arranged in spaced apart disposition above a supply of coating material contained in a tank 15 and is successively engaged with and withdrawn from coating material 16 present in the tank 15 to take up material therefrom.

Conveniently the tank 15 is raised or lowered so as to bring the coating material 16 into contact with the belt 17 for the time being existing on the rollers 12, 13, 14, the extent of movement being such as to cause the lower part 18 of the belt 17 to become immersed in the coating material 16 or simply to engage the surface 19 thereof according to the nature of the coating step required.

In the arrangement illustrated three rollers are provided, two such rollers 12, 13 being arranged at a common level and serving to support the fabric 11/belt 17 and the third roller 14 being at a lower level and being after the nature of a guide roller to locate the lower part of the fabric/belt. At least one of the upper rollers 12, 13 is driven so as to progress the fabric/belt about the roller arrangement.

The process steps are shown in FIG. 1 and comprise, in succession, dip coating steps, FIGS. 1*b* to 1*e*, a lick-coating step, FIGS. 1*f* and 1*g*, two dip-coating steps, FIGS. 1*h* to 1*k*, and a further lick-coating step, FIGS. 1*l* and 1*m*, each step including drying/sintering of the applied layer, FIGS. 1*c*, 1*e*, 1*g*, 1*i*, 1*k* and 1*m*.

Figure 2:
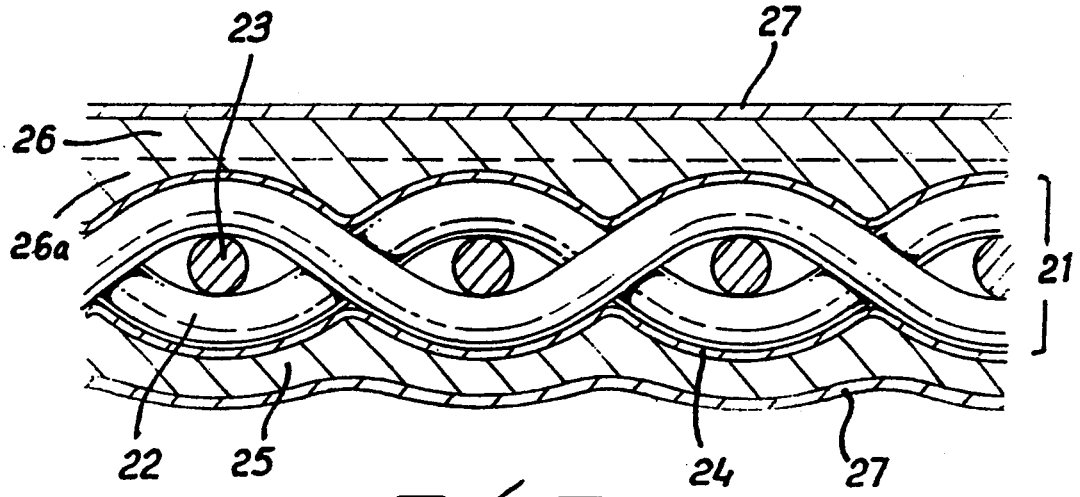
FIG. 2 is a longitudinal section taken through a fabric coated in accordance with the method of FIG. 1.

The base fabric 21, see FIG. 2, is of plain weave construction and is woven from 1100 d.tex Kevlar or Technora multi-filament yarns 22, 23 the warp and weft densities in the loom being 11.22 and 9.45 yarns/cm. The fabric weight is 225 grams/meter$^2$ and the fabric thickness is 0.36 mm.

On tensioning of the base fabric the length thereof increases by approximately 1.9% whilst the width reduces by approximately 4.4%, the fabric thickness increasing to 0.43 mm.

The initial dip coating steps serve to apply a bonding coat 24 to the base fabric 21 and the mix is merely a polytetrafluoroethylene bonding material. For the initial lick coating step, which step forms coating layer 26*a* at the support side of the base fabric, and the remaining dip coating steps, which apply coating material to both sides of the fabric, that is to say for the weave filling steps which form coating layers 25, 26 at the respective sides of the fabric, the mix also includes silicate bodies, typically solid glass beads having a diameter of between 53 and 105 microns but preferably monosized at approximately 90 microns. Indeed, it is believed that the use of monosized beads offers improved weave filling as compared with the use of beads of a size randomly distributed with a range of diameters. Typically, the silicate bodies are present in the relevant coating layers in like amount by weight to the dried/sintered P.T.F.E. coating material. The final coating step applies a top coat 27 of P.T.F.E. having metallic particles/flake included therein. An additional weave filling coating step will ordinarily be applied, notwithstanding that such additional step is not shown in FIG. 1.

Thus, the bonding coat 24 consists of two layers at each side of the belt to give a total coating weight of 250 grams/meter$^2$ whilst the weave filling coats 25, 26 which respectively comprise three coating layers and two coating layers, have a total weight of 400 grams/meter$^2$. The final or top coats 27, each of which comprises two layers, have a total weight of 100 grams/meter$^2$. The finished thickness of the coated belt is 0.69 mm.

The fabric is illustrated diagrammatically in FIG. 2, it being seen that the bonding layers, which layers promote adhesion of the subsequent coating layers to the base fabric, permeate the surface of the multifilament yarns and bridge the interstices in the fabric and that the glass beads serve to fill the recesses in and defined by the bonding layers to give a substantially flat outer surface to the belt particularly at the support side thereof, the top coat being of sensibly constant thickness and thus having a surface form of similar character to that formed by the weave filling layers. It will be appreciated, of course, that, after coating, the belt will be calendered.

The invention is not restricted to the detail of the embodiment hereinbefore described, since alternatives will readily present themselves to one skilled in the art. Thus, for example, whilst the bonding coats do improve adhesion of the weaving filling layers to the base weave, the bonding coats may, in some circumstances, be omitted.

The number of weave-filling layers may be varied according to specific requirements and more than one such layer may be applied by lick coating. The solids content of the PTFE dispersion may be other than 50%, indeed an increased solids content, say to 70%, is desirable as this reduces the tendency of the coating to contour the fabric weave structure. The increased solids content also facilitates weave filling and drying/sintering of the PTFE, and has advantageous effects on the thermal characteristics of the belt in use.

Other weave structures and other yarns, for example glass yarns, may, of course, be used, and the PTFE coating material may include such additives as are appropriate to introduce requisite characteristics into the belt according to its intended end use. For example, it may be found convenient to use metallized beads, whether in the weave filling layers and/or in the top coat, and thus dispense with the need to include metallic particles/flake in the top coat.

I claim:

1. The method of producing a fusing belt which includes the steps of providing a woven base fabric, said fabric having opposed fabric surfaces and recesses in said surfaces formed by and between yarns of the fabric present at said surfaces, applying successive coating layers of a synthetic plastic coating material to said base fabric, wherein the said application of successive coating layers includes the step of filling the recesses of at least one of said opposed fabric surfaces by the application, utilizing a lick coating technique, of at least one said synthetic plastic coating layer which contains silicate bodies, followed by application utilizing a dip coating technique, of at least one said synthetic plastic coating layer; thereby forming a coated fabric.

2. The method as claimed in claim 1, wherein each coating layer is dried prior to application of a succeeding layer.

3. The method as claimed in claim 1, including the step of applying a bonding coat of synthetic plastic coating material to the base fabric prior to the application of the at least one silicate body containing layer.

4. The method as claimed in claim 2 wherein the silicate bodies present in said at least one synthetic plastic coating layer are present in equal amount by weight to the weight of the dried synthetic plastic coating material.

5. The method as claimed in claim 1 including the further step of calendering the coated fabric.

6. The method as claimed in claim 1, wherein each coating layer is sintered prior to application of a succeeding layer.

7. The method as claimed in claim 1 comprising driving air through the woven base fabric during the lick coating step.

8. The method as claimed in claim 6 wherein the silicate bodies present in said at least one synthetic plastic coating layer are present in equal amount by weight to the weight of the sintered synthetic plastic coating material.

* * * * *